US007365237B2

(12) United States Patent
Wagner

(10) Patent No.: US 7,365,237 B2
(45) Date of Patent: Apr. 29, 2008

(54) LIQUID METAL REACTOR AND METHOD FOR TREATING MATERIALS IN A LIQUID METAL REACTOR

(75) Inventor: Anthony S. Wagner, Lakeway, TX (US)

(73) Assignee: Clean Technologies International Corporation, Little Rock, AR (US)

( * ) Notice: Subject to any disclaimer, the term of this patent is extended or adjusted under 35 U.S.C. 154(b) by 417 days.

(21) Appl. No.: 10/255,268

(22) Filed: Sep. 26, 2002

(65) Prior Publication Data

US 2004/0064010 A1 Apr. 1, 2004

(51) Int. Cl.
*G21F 9/00* (2006.01)

(52) U.S. Cl. ..... 588/2; 588/15; 588/16; 588/252

(58) Field of Classification Search ..... 588/15, 588/2, 16, 252
See application file for complete search history.

(56) References Cited

U.S. PATENT DOCUMENTS

| | | | | |
|---|---|---|---|---|
| 4,204,975 | A | 5/1980 | Thiele | |
| 4,263,163 | A | 4/1981 | Ross | |
| 4,300,056 | A | 11/1981 | Gagneraud | |
| 4,571,307 | A | 2/1986 | Bonniaud et al. | |
| 5,000,101 | A | 3/1991 | Wagner | |
| 5,271,341 | A | 12/1993 | Wagner | |
| 5,301,620 | A * | 4/1994 | Nagel et al. | 110/346 |
| 5,359,947 | A | 11/1994 | Wagner | |
| 5,431,113 | A | 7/1995 | Wagner | |
| 5,452,671 | A | 9/1995 | Wagner | |
| 5,461,991 | A | 10/1995 | Wagner | |
| 5,489,734 | A * | 2/1996 | Nagel et al. | 588/1 |
| 5,545,796 | A | 8/1996 | Roy et al. | |
| 5,553,558 | A | 9/1996 | Wagner | |
| 5,564,351 | A | 10/1996 | Wagner | |
| 5,592,027 | A | 1/1997 | Jacq et al. | |
| 5,640,702 | A | 6/1997 | Shultz | |
| 5,678,236 | A | 10/1997 | Macedo et al. | |
| 5,732,365 | A * | 3/1998 | Howard et al. | 588/10 |
| 5,814,824 | A | 9/1998 | Hamby et al. | |
| 5,832,845 | A | 11/1998 | Wagner | |
| 5,866,095 | A * | 2/1999 | McGeever et al. | 423/659 |
| 6,037,517 | A | 3/2000 | Wagner | |
| 6,069,290 | A | 5/2000 | Wagner | |
| 6,195,382 | B1 | 2/2001 | Wagner | |
| 6,227,126 | B1 | 5/2001 | Wagner | |
| 6,346,221 | B1 | 2/2002 | Wagner | |
| 6,355,857 | B1 | 3/2002 | Wagner | |
| 6,669,755 | B2 | 12/2003 | Wagner | |
| 6,717,026 | B2 | 4/2004 | Wagner | |
| 2002/0173687 | A1 | 11/2002 | Wagner | |
| 2005/0254988 | A1 | 11/2005 | Wagner | |

FOREIGN PATENT DOCUMENTS

| | | | |
|---|---|---|---|
| DE | 3140020 | A | 5/1983 |
| GB | 1446016 | | 8/1976 |
| GB | 2109984 | * | 6/1983 |
| JP | 54-130799 | * | 10/1979 |
| JP | 54-130799 | A | 10/1979 |
| JP | 58-146898 | * | 9/1983 |
| JP | 2001-194495 | * | 7/2001 |
| JP | 2001-194496 | * | 7/2001 |

* cited by examiner

*Primary Examiner*—Steven Bos
*Assistant Examiner*—Paul Wartalowicz
(74) *Attorney, Agent, or Firm*—Russell D. Culbertson; The Culbertson Group, P.C.

(57) ABSTRACT

A target material (60) to be treated in a liquid reactant metal is loaded into a containment area defined within a liquid reactant metal treatment vessel (11). The containment area is then placed below the level (L) of the liquid reactant metal in the treatment vessel (11). This places the target material (60) in contact with the liquid reactant metal and allows the desired reactions to occur. Reaction products are then removed from the treatment vessel (11). Placing the containment area below the level (L) of liquid reactant metal in the treatment vessel (11) may be accomplished by pivoting the vessel from a loading position to a treating position to shift the level of liquid reactant metal in the vessel.

12 Claims, 4 Drawing Sheets

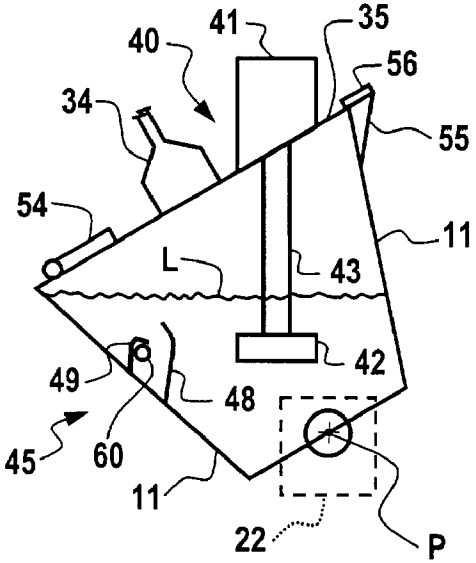
Fig. 4
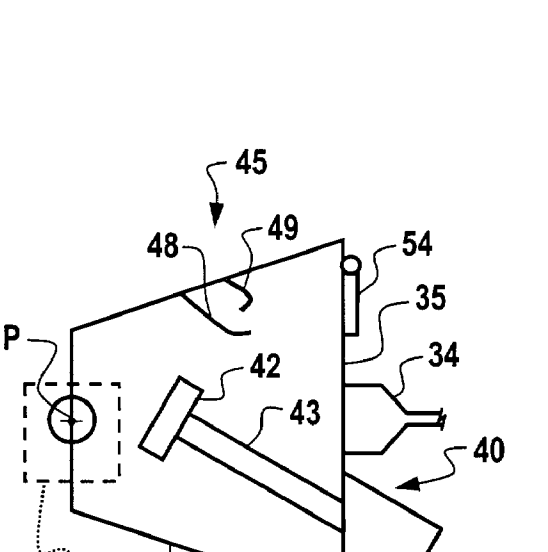
Fig. 5
Fig. 6

LIQUID METAL REACTOR AND METHOD FOR TREATING MATERIALS IN A LIQUID METAL REACTOR

TECHNICAL FIELD OF THE INVENTION

This invention relates to systems for treating materials, especially waste materials, with liquid reactant metals. The invention encompasses both methods for treating materials in a liquid reactant metal and treatment systems for performing the treatment operations.

BACKGROUND OF THE INVENTION

It is known that certain chemically active metals or reactant metals held as a liquid at elevated temperatures have the ability to chemically reduce organic compounds. Suitable reactant metals include aluminum, magnesium, lithium, and alloys of these metals as described in U.S. Pat. Nos. 5,000,101, 6,069,290, and 6,355,857 to Wagner. The entire content of each of these prior patents is hereby incorporated in this disclosure by this reference. These liquid reactant metals chemically reduce organic molecules to produce mostly hydrogen and nitrogen gas, elemental carbon, char, and metal salts. Most metals mixed with the organic materials or bound up in organic molecules in the waste materials dissolve or melt into the liquid reactant metal. Low boiling point metals such as Mercury may go to a gaseous state and separate from the liquid reactant metal along with other gases. Other metals alloy with the liquid reactant metal or separate from the liquid reactant metal by gravity separation. Liquid reactant metals are also useful in treating radioactive wastes and mixed radioactive and non-radioactive wastes. U.S. Pat. No. 6,355,857 discloses processes for treating radioactive and mixed radioactive and nonradioactive wastes in a liquid reactant metal reactor. Many of the materials in the waste are chemically reduced to produce relatively innocuous compounds or constituent elements. Radioactive metals such as Uranium and transuranic metals are dissolved or otherwise dispersed into the liquid reactant metal. As shown in U.S. Pat. No. 6,355,857 and U.S. patent application Ser. No. 10/059,808, the entire content of which is incorporated by reference, radiation absorbing metals and radiation moderating metals may be included in the liquid reactant metal. The liquid reactant metal, trapped radioactive isotopes, and radiation absorbing or moderating materials may be solidified to form an ingot. In the resulting ingot the radiation absorbing materials absorb radioactive emissions from the trapped radioactive isotopes and greatly reduce the amount of radiation escaping from the ingot. Thus, the ingot provides a good vehicle for the relatively safe, long-term storage of radioactive isotopes.

The liquid reactant metal treatment processes described above and in U.S. Pat. No. 6,355,857 and application Ser. No. 10/059,808 provide ways to effectively isolate radioactive isotopes from mixed non-radioactive and radioactive wastes and effectively store radioactive materials. There remains a need, however, for improved systems for providing the necessary contact between the material to be treated and the reactant metal, and for handling the resulting reaction products. The need is particularly acute for high-level nuclear waste materials such as spent nuclear fuel rods.

SUMMARY OF THE INVENTION

The present invention provides treatment methods and devices for treating various types of materials with liquid reactant metals. Although the invention is applicable for treating many types of materials, the present treatment system is especially suited for treating articles such as spent nuclear fuel rods or similar articles that include high-level radioactive materials. The invention places the radioactive elements from the radioactive material in a storage mixture that includes the liquid reactant metal and radioactive emission control materials. This storage mixture can be cooled to form ingots in which the radioactive elements may be stored in relative safety over long periods of time.

As used in this disclosure and the accompanying claims, the radioactive atoms dissolved or otherwise liberated from the target material being treated will be referred to as "radioactive material decomposition constituents." The term "decomposition" is not used here to imply that the atoms dispersed into the reactant metal from the target material change from one isotope to another by radioactive emission. Rather the term "decomposition" is used to describe the fact that the respective atoms were once part of the article made up of the target material being treated or were once included in the physical structure of the target material, and have been released from the target material into the liquid reactant metal. This release into the liquid reactant metal at least partially, and preferably completely, eliminates the original article or physical structure of the target material.

The materials included in a storage mixture according to the invention to absorb or moderate radioactive emissions from the radioactive material decomposition constituents in the storage mixture will be referred to in this disclosure and the accompanying claims as "radioactive emission control materials." The word "control" in this phrase is not intended to imply that the materials prevent radioactive emissions from the radioactive isotopes in the storage mixture. It will be appreciated that the "control" provided by the radioactive emission control material is in absorbing the radioactive emissions that inevitably occur, either producing a stable isotope or one that degrades further by radioactive emission. The phrase radioactive emission control materials also encompasses moderating materials that absorb high energy particles or radiation and produce lower energy emissions in response.

According to the invention, material to be treated, that is, the target material, is placed or loaded into a containment area defined within a liquid reactant metal treatment vessel. The containment area is then placed below the level of the liquid reactant metal in the treatment vessel. This places the target material in contact with the liquid reactant metal and allows the desired reactions to occur. Reaction products are then removed from the treatment vessel.

In one form of the invention the treatment vessel is held in a first position to load the target material into the vessel. The treatment vessel is then tilted to a treatment position in order to place the containment area, and thus the target material, below the level of liquid reactant metal in the vessel. In other forms of the invention, liquid reactant metal is poured or otherwise transferred from a separate vessel into the treatment vessel to place the containment area below the liquid reactant metal level in the treatment vessel.

The manner in which reaction products are removed from the treatment vessel depends upon the nature of the target materials being treated. Where the target material is a spent nuclear fuel rod for example, the reaction products comprise decomposition constituents made up of radioactive materials and other materials from the spent fuel rods dissolved or otherwise dispersed in the liquid reactant metal. In this case, the reaction products are removed from the treatment vessel by transferring the entire melt including the reactant metal, decomposition constituents, and radioactive emission control materials into ingots for cooling. In forms of the invention in which the material to be treated includes hydrocarbons or other materials that are chemically reduced by the liquid reactant metal, the reaction products include products from the chemical reduction reaction. These reaction products are removed from the treatment vessel in gaseous, liquid, or solid form as is known in the art of liquid reactant metal reactors.

The present invention provides a relatively simple arrangement for placing materials to be treated in contact with a liquid reactant metal. The invention is particularly advantageous for treating spent nuclear fuel rods because the system allows the rods to be treated in a single vessel which may be loaded easily in an automated fashion necessary for handling such radioactive materials. The resulting storage mixture may then be poured off into molds in an automated fashion to form the desired long-term storage products.

These and other objects, advantages, and features of the invention will be apparent from the following description of the preferred embodiments, considered along with the accompanying drawings.

BRIEF DESCRIPTION OF THE DRAWINGS

FIG. 4 is an end view of the treatment vessel shown in FIGS. 2 and 3, in a loading position.

FIG. 5 is an end view similar to FIG. 4 but with the treatment vessel in the treating position.

FIG. 6 is an end view similar to FIG. 4 but with the treatment vessel in the pouring position.

DESCRIPTION OF PREFERRED EMBODIMENTS

Figure 1:
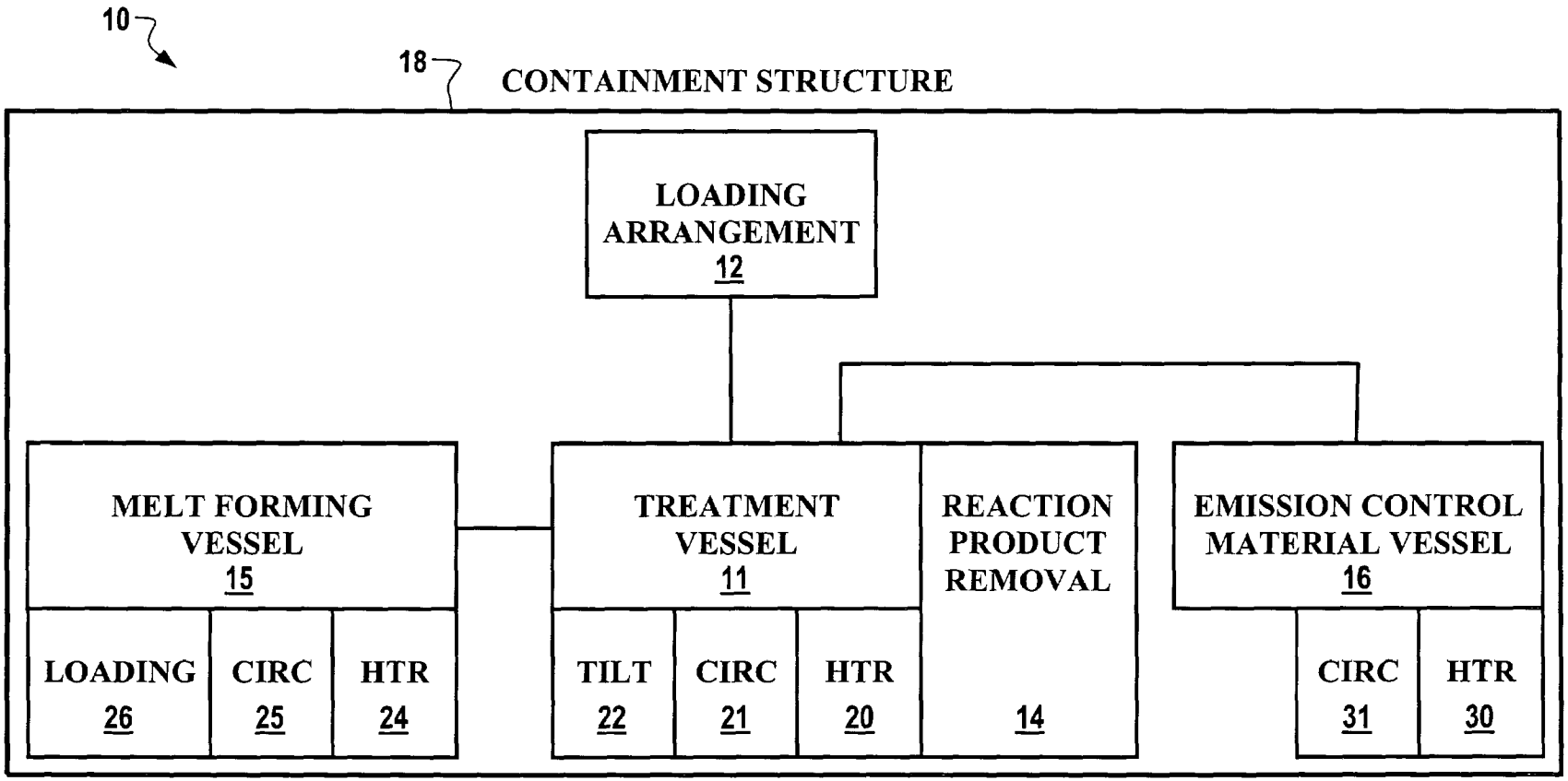
FIG. 1 is a schematic representation of a treatment system embodying the principles of the invention.

Referring to the schematic representation shown in FIG. 1, a liquid reactant metal treatment system 10 embodying the principles of the invention includes a treatment vessel 11, a target material loading arrangement 12 and a reaction product removal arrangement 14. Alternative forms of the invention may also include a reactant metal forming vessel or melt forming vessel 15 and an emission control material vessel 16. Depending upon the nature of the target material being treated in system 10, the entire system may be contained within a suitable containment vessel or housing 18.

One preferred treatment vessel 11 will be discussed in detail below with reference to FIGS. 2 through 6. Any treatment vessel 11 according to the invention will include a vessel suitable for containing a liquid reactant metal such as molten aluminum or mixtures or alloys of molten reactant metal together with other metals, including radioactive emission control materials. Although liquid aluminum preferably makes up the bulk of the liquid reactant metal in the preferred treatment system, liquid aluminum may be replaced partially or completely with other metals such as liquid magnesium or lithium for example. All of these liquid reactant metals are extremely aggressive and thus treatment vessel 11 must be either formed from, or coated with, a suitable refractory material that will not react substantially with the reactant metal. Treatment vessel 11 must also be capable of maintaining structural integrity at the required elevated operating temperatures.

In some forms of the invention, a heating device 20 will be associated with treatment vessel 11. Heating device 20 might be used for maintaining the liquid reactant metal in treatment vessel 11 at the desired temperature for performing the process or for melting an initial charge of metals in addition to maintaining the reactant metal temperature. Heating device 20 may include a fossil fuel burning system or an electrical induction heating system, or any other heating system suitable for use in liquid reactant metal reactors. A circulating arrangement 21 may also be associated with treatment vessel 11 for circulating the liquid reactant metal within the vessel. Some forms of the invention may also include a tilting mechanism or arrangement 22 for tilting treatment vessel 11 from one position to another in the course of the treatment process. Tilting arrangement 22 will be described in further detail with reference to FIGS. 2 through 6.

Target material loading arrangement 12 is included in system 10 for loading the material to be treated, that is, the target material, into treatment vessel 11. Target material loading arrangement 12 may be any of a number of different structures or devices depending upon the particular target material. For example, where the target material is comprised of spent nuclear fuel rods or portions of such fuel rods, loading arrangement 12 may comprise a remotely operated robotic arm or other structure for picking up one or more of the highly radioactive spent fuel rods and placing the rod or rods into a target material containment structure within treatment vessel 11. This target material containment structure is not shown in the schematic diagram of FIG. 1, but will be described in detail below with reference to FIGS. 4 through 6. A suitable door or hatch will commonly be included with treatment vessel 11 for providing access to the interior and the treatment vessel for the target material loading arrangement 12. An example loading hatch will also be described below with reference to FIGS. 2 and 3.

Reaction product removal arrangement 14 may include a number of different elements depending upon the nature of the target material. Again using the example of a target material comprising a spent nuclear fuel rod, reaction product removal arrangement 14 will comprise a structure associated with treatment vessel 11 for pouring or otherwise physically removing the storage mixture and directing the storage mixture to molds (not shown in FIG. 1). One type of reaction product removal arrangement comprises a spout or similar structure on vessel 11 through which the molten contents of vessel 11 may be poured into molds. This pouring structure and the molds will be described below with particular reference to FIG. 6. It will be appreciated that tilting arrangement 22 may cooperate with reaction product removal arrangement 14 in this form of the invention or may even be considered to be part of the reaction product removal arrangement.

Where the target material includes materials such as hydrocarbons or other materials that are chemically reduced by the liquid reactant metal, the reaction product removal arrangement may include a gaseous reaction product removal component and a solid/liquid reaction product removal component. Examples of these gaseous liquid/solid reaction product removal components are described in U.S. Pat. No. 6,227,126, the entire content of which is hereby incorporated herein by reference.

The reactant metal conditioning vessel 15 shown in FIG. 1 may comprise a separate vessel including its own heating arrangement 24, circulating arrangement 25, and loading arrangement 26. Vessel 15 may be loaded with metals in solid form through loading arrangement 26, and this charge material may be heated and placed in molten form using heating arrangement 24. Circulating arrangement 25 may be used to circulate the molten materials in vessel 15 and ultimately produce the desired uniform liquid reactant metal for use in treatment vessel 11. It will be appreciated that other preferred forms of the invention may charge treatment vessel 11 directly with solid metals for inclusion in the desired liquid reactant metal, and thus vessel 15 and its associated components may be eliminated in some forms of the invention. Where a separate liquid reactant metal forming and conditioning vessel 15 is employed, the liquid reactant metal may be transferred to treatment vessel 11 in any suitable fashion such as by pouring or by transfer through a suitable liquid metal pumping system, not shown in FIG. 1.

In forms of the invention in which the target material includes radioactive constituents to be captured in the liquid reactant metal, the treatment process will include adding radioactive emission control material to the liquid reactant metal to ultimately produce a storage mixture. The emission control materials may be added to the liquid reactant metal in any of a number of different ways within the scope of the invention. In one form of the invention, the emission control materials are included with the original materials making up the liquid reactant metal. In this form of the invention the emission control material is already in the liquid reactant metal at the time the target material is added to treatment vessel 11. In other forms of the invention, the emission control materials may be added to the treatment vessel after the target materials are contacted with the liquid reactant metal. In these forms of the invention, emission control material vessel 16 shown in FIG. 1 may be used to melt and condition the emission control materials to be added to treatment vessel 11. Alternatively, the target material may first be decomposed in the liquid reactant metal in vessel 11, and then the resulting mixture may be transferred to emission control material vessel 16. The materials in vessel 16 may then be circulated and mixed thoroughly to produce the desired uniform storage mixture. The storage mixture may then be transferred from vessel 16 into ingot molds to form a desired storage product for the radioactive materials.

Regardless of the manner in which vessel 16 is employed according to the invention, where the vessel is present in the system, it will commonly include its own heating arrangement and circulating arrangement 31. Transfer of the storage mixture to the ingots may be accomplished by physically tilting vessel 16 to pour the mixture or by a suitable pumping arrangement. Where materials from vessel 16 are added to treatment vessel 11, the transfer may similarly be accomplished by pouring the liquid metals from vessel 16 or by pumping the liquid metals.

The nature of containment structure 18 will depend upon the nature of the target material being treated in system 10. Where high-level radioactive materials such as spent nuclear fuel rods are being treated, containment structure 18 may comprise a lead lined, reinforced concrete structure. Where no radioactive materials are being treated in system 10, the containment structure may comprise any suitable structure for containing untreated materials, reaction product gases, or molten metals that may inadvertently escape from the various vessels or containers in the system.

An example treatment vessel 11 is shown in FIGS. 2 through 6. The vessel itself and its associated components may be described with reference to FIGS. 2 through 4. The operation of this example treatment vessel 11 will be described below with reference to FIGS. 4 through 6.

Figure 2:
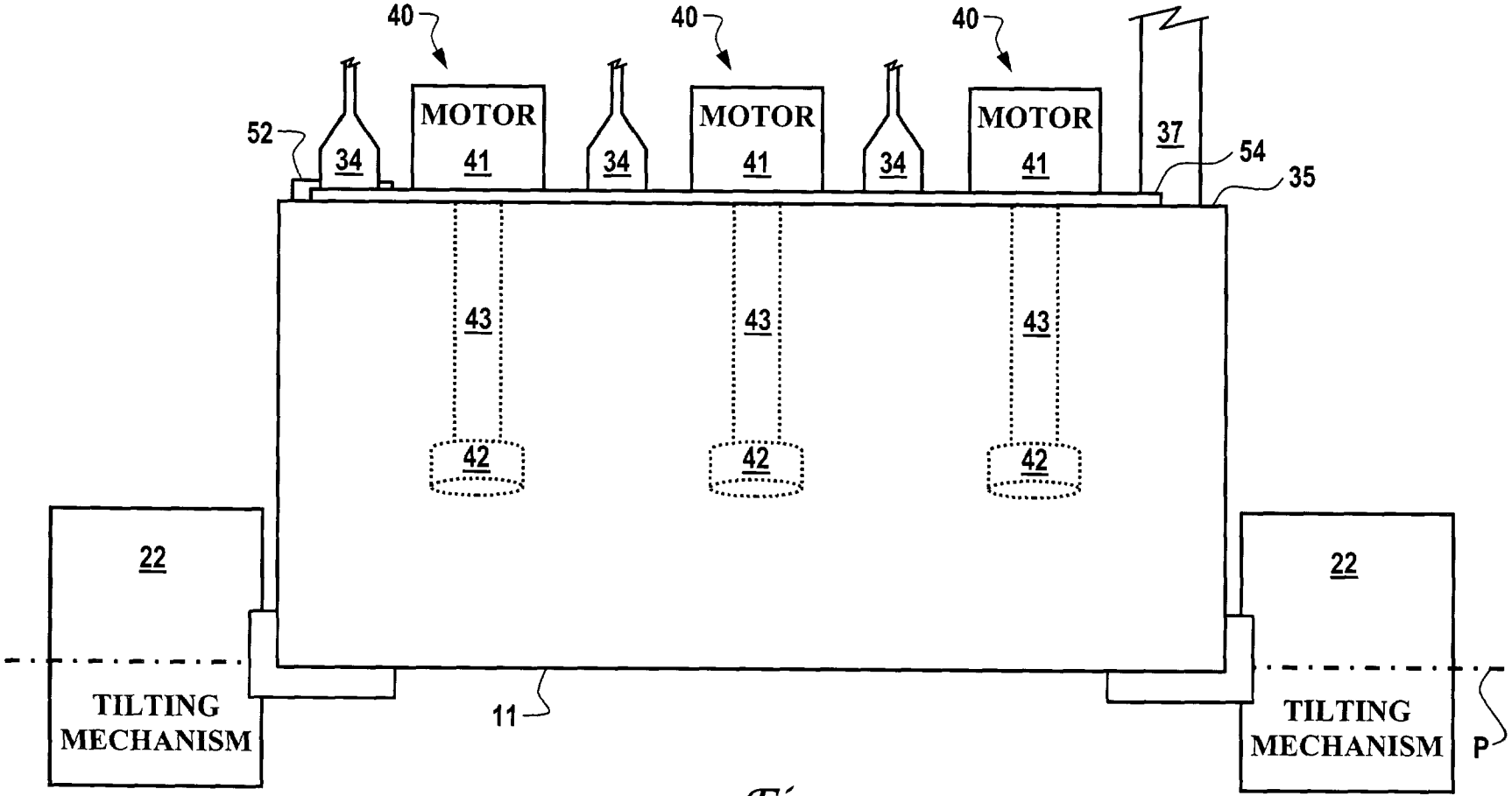
FIG. 2 is a longitudinal side view of a treatment vessel that may be used in the treatment system shown in FIG. 1.

In the side view of treatment vessel 11 provided in FIG. 2, the vessel is shown mounted on tilting arrangement 22 and adapted to tilt or pivot about an axis P. The tilting of treatment vessel 111 in the course of treating a target material will be described further below with reference to FIGS. 4 through 6. Mechanisms for tilting vessels containing molten or liquid metals are well known in the metal production and recycling industry. The tilting arrangement 22 shown in FIG. 2 may comprise a gear or chain driven device adapted to drive the vessel about pivot axis P. An alternate tilting system may comprise a structure for suspending vessel 11 and a device for lifting one side of the vessel so as to cause the vessel to pivot about a pivot point associated with the suspension structure. Any other suitable vessel tilting arrangement may be used within the scope of the present invention.

A number of fossil fuel burners 34 are mounted on a top enclosure 35 of vessel 11. These burners 34 form part of the heating system 20 shown schematically in FIG. 1, and may be used to burn a suitable fuel to apply heat to the interior of vessel 11. The heat may be required to melt the reactant metals and other metals placed in vessel 11, or may be required to maintain the contents of the vessel 11 at the desired temperature during treatment. A flue or stack 37 is connected to vessel 11 for removing combustion products from the fuel burned at burners 34. It will be noted that the flue 37 must include a flexible or articulating portion, or a separating structure (not shown) in order to accommodate the tilting movement of vessel 11. Also, conduits providing fuel to burns 34 must be flexible or articulating in order to accommodate the tilting movement of the vessel.

Circulation within vessel 11 is provided by a number of circulating devices 40 mounted on vessel top 35. These circulating devices 40 correspond to the circulating arrangement 21 shown schematically in FIG. 1. Each circulating device 40 includes a motor 41 adapted to drive an impeller or other agitating device 42 on a shaft 43 within the interior of vessel 11. It will be appreciated that the agitating device 42 and parts of the shaft 43 exposed to the liquid reactant metal must be made of a suitable refractory material or coated with such material in order to protect the components from the reactant metal. The agitating device 42 and parts of shaft 43 within vessel 11 must also be able to maintain structural integrity at the operating temperatures within the vessel. These temperatures will depend upon the liquid reactant metal and the target materials, but will generally be approximately 800 degrees Celsius or greater.

As shown in FIG. 4, vessel 11 includes a containment structure 45 mounted in its interior. This containment structure 45 defines a containment area in which target materials are treated according to the invention. The particular containment structure 45 shown in the present figures is well adapted for containing spent nuclear fuel rods as they are treated according to the invention. Containment structure 45 includes a lower or shelf component 48 and a top or roof component 49. The space between the distal end of top component 49 and the distal end of lower component 48 allows the spent fuel rods to be dropped onto the lower component. Top component 49 prevents the rods from escaping from the containment area as the rods are submerged in the liquid reactant metal as will be described further below with reference to FIG. 5. As can be appreciated from FIG. 2, the length of vessel 11 may be such that the containment structure mounted within the vessel may accommodate an entire spent nuclear fuel rod, which may be on the order of 12 feet long.

Figure 3:
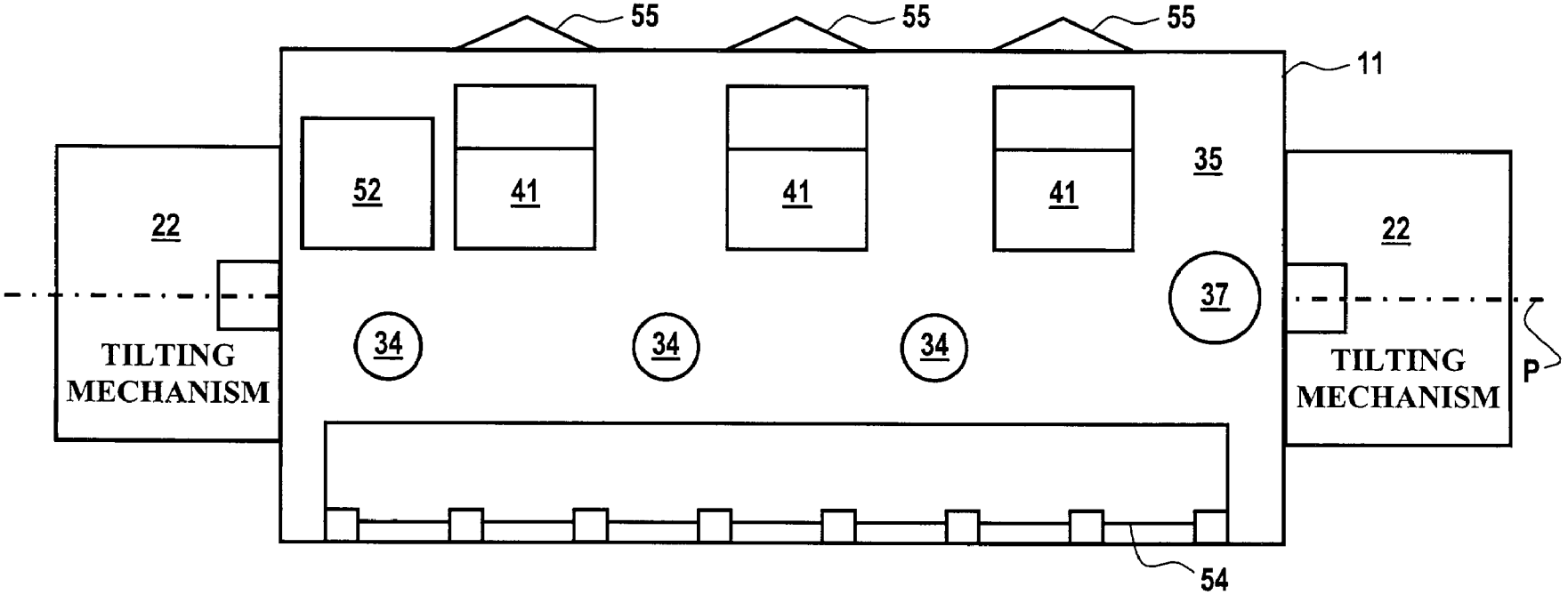
FIG. 3 is a top view of the treatment vessel shown in FIG. 2.

Referring to FIG. 3, the top 35 of the treatment vessel includes a door or hatch 52 through which solid or liquid materials for the liquid reactant metal may be added to vessel 11. The hatch 52 shown in FIG. 3 may comprise a simple pivoting hatch that pivots upwardly to expose an opening through treatment vessel top 35. Numerous other arrangements may be used with treatment vessel 11 for adding components of the liquid reactant metal or emission control materials to be used for radioactive target materials.

The vessel top 35 also includes a target material loading door or hatch 54. This loading door 54 may be opened to expose a loading access opening in vessel top 35 which provides access to containment structure 45 to facilitate loading a target material into the containment structure. In the form of the invention shown in FIGS. 2 through 6, which is specifically adapted for treating spent nuclear fuel rods, loading door 54 extends the entire length of the elongated vessel 11 to accommodate loading an entire fuel rod. The illustrated loading door 54 comprises simply a hinged door or hatch that may be pivoted upwardly to expose the loading access opening. Any other suitable door or hatch may be used within the scope of the present invention. Where other types of heating arrangements are used that do not require an area within vessel 11 for containing combustion gases, it may also be possible to eliminate door 54 and simply leave the target material loading access opening exposed throughout the treatment cycle. The same may be said for charging door 52.

As shown in FIGS. 3 and 4, the tilting treatment vessel 11 includes one or more spouts 55 to facilitate pouring the liquid contents of the vessel into a subsequent container, whether the subsequent container is an ingot forming mold or another vessel such as vessel 16 described above with reference to FIG. 1. Each pouring spout 55 may be associated with a lid or door 56 which may be pivoted or otherwise moved out of the way for pouring.

The operation of the tilting treatment vessel 11 shown FIGS. 2 through 6 may be described with reference to the series of FIGS. 4 through 6. FIG. 4 shows treatment vessel 11 in a loading position with loading door 54 open and ready to receive a target material in containment structure 45. FIG. 4 also shows a spent nuclear fuel rod 60 loaded in containment structure 45. In the illustrated loading position, treatment vessel 11 is already loaded or charged with a liquid reactant metal. The level of the liquid reactant metal is shown at line L in FIGS. 4 and 5.

Once the target material (rod 60) is loaded through loading door 54 and vessel 11 contains the desired quantity of liquid reactant metal, the vessel is tilted by the tilting mechanism 22 to the treating position shown in FIG. 5. In this treating position, the containment area defined by containment structure 45, and thus the target material (rod 60) is located well below the level L of liquid reactant metal in vessel 11. The target material is thus held in contact with the liquid reactant metal. Circulating devices 40 may be operated in this position to circulate the liquid reactant metal and thereby enhance the dissolution or decomposition of the target material. Tilting arrangement 22 may also be operated to tilt treatment vessel 11 back and forth slightly to slosh liquid reactant metal back and forth within the vessel to provide some mixing of liquid reactant metal in the vessel. This sloshing action may even provide sufficient mixing in some cases to eliminate the need for circulating devices 40.

The particular containment structure 45 shown in FIGS. 4 through 6 uses the top component 49 to retain the target material, fuel rod 60, in the containment area. As vessel 11 is tilted, rod 60 will eventually be buoyed up off of lower component 48 by the liquid reactant metal as the level L passes the level of the lower component. Rod 60 will continue to be buoyed up until it reaches top component 49. The distal end of top component 49 includes a downward hook shape to catch the rod 60 and prevent it from leaving the containment area through the opening defined between the distal end of top component 49 and the distal end of lower component 48.

It will be appreciated that containment structure 45 made up of overlapping components 48 and 49 is preferred for its simplicity. However, numerous other types of containment arrangements may be used with in the scope of the invention. For example, alternative containment structures may include a cage fixed within vessel 11 having a separate cage door or closure. Also, some forms of the invention may include a removable cage or containment structure that may be removed from vessel 11, loaded with target material, and then placed back in the vessel and fixed in the desired position within the vessel. All of these alternatives are encompassed within the scope of the accompanying claims.

Once the target material, in this case spent fuel rod 60, is totally dissolved or otherwise dispersed in the liquid reactant metal below level L in FIG. 5, and the liquid reactant metal has been circulated sufficiently to disperse the radioactive decomposition constituents throughout the liquid reactant metal, tilting arrangement 22 is operated to tilt vessel 11 to the pouring position shown in FIG. 6. In this position, all of the liquid contents of treatment vessel 11 pour through spout 55 into the receiving device shown at 58 in the figure. Receiving device 58 may comprise ingot forming molds where the emission control materials have been added to form the desired storage mixture within vessel 11. Alternatively, receiving device 58 may comprise an emission control material vessel such as vessel 16 shown in FIG. 1. In this latter case, the storage mixture would be formed in vessel 16 and then transferred to the desired ingot forming molds.

In any event, the storage mixture received in an ingot forming mold may be allowed to cool and solidify to produce a storage product for the radioactive material decomposition constituents. The ingot may then be encapsulated in a suitable radiation shielding material.

The above described preferred embodiments are intended to illustrate the principles of the invention, but not to limit the scope of the invention. Various other embodiments and modifications to these preferred embodiments may be made by those skilled in the art without departing from the scope of the following claims.

The invention claimed is:

1. A method for treating an article that includes a radioactive material, the method including the steps of:

(a) loading the article into a containment area defined in a treatment vessel;

(b) while the article is being held in the containment area, tilting the treatment vessel from a loading position to a treatment position to place the article in contact with a liquid reactant metal in the treatment vessel to decompose the radioactive material in the article into radioactive material decomposition constituents dispersed in the liquid reactant metal;

(c) producing a storage mixture including the radioactive material decomposition constituents dispersed in the liquid reactant metal together with radioactive emission control materials, the radioactive emission control materials being present in the storage mixture in an effective ratio with radioactive material decomposition constituents in the storage mixture to limit radiation emissions from the storage mixture; and (d) cooling the storage mixture in one or more molds to form a solidified storage product for the radioactive material decomposition constituents.

2. The method of claim 1 wherein the article comprises one or more pieces of a nuclear reactor fuel rod or one or more whole fuel rods.

3. The method of claim 1 further including the step of encapsulating the solidified storage product in a radiation shielding material.

4. The method of claim 1 wherein the step of producing the storage mixture includes combining radioactive emission control materials and the liquid reactant metal after placing the article in contact with the liquid reactant metal.

5. The method of claim 1 wherein the step of producing the storage mixture includes combining the radioactive emission control materials and the liquid reactant metal prior to placing the article in contact with the liquid reactant metal.

6. The method of claim 1 further including the step of pouring the storage mixture from the treatment vessel into one or more molds.

7. A method of treating a target material in a liquid reactant metal, the method including the steps of:

(a) loading a target material into a containment area defined in a treatment vessel and holding the target material in the containment area, the containment area being defined within a boundary separating the containment area from the remainder of the volume of the treatment vessel;

(b) with the target material held in the containment area, tilting the treatment vessel to a treatment position to change a level of a liquid reactant metal in the treatment vessel so as to place at least a portion of the containment area below the liquid reactant metal in the treatment vessel and thereby place the target material in contact with the liquid reactant metal; and (c) removing reaction products from the treatment vessel while the liquid reactant metal is maintained in a liquid state.

8. A method of treating a target material in a liquid reactant metal, the method including the steps of:

(a) containing a volume of liquid reactant metal in a treatment vessel;

(b) while containing the liquid reactant metal in the treatment vessel, loading a target material into a position in the treatment vessel in which the target material is contained out of contact with the liquid reactant metal in the treatment vessel;

(c) tilting the treatment vessel to place the target material in contact with the liquid reactant metal; and (d) removing reaction products from the treatment vessel.

9. The method of claim 8 wherein the step of loading the target material into the treatment vessel includes loading the target material into a containment area defined in the treatment vessel.

10. The method of claim 9 further including the step of tilting the treatment vessel to a loading position and maintaining the treatment vessel in the loading position during the step of loading the target material into the containment area, the containment area residing above the level of the liquid reactant metal in the treatment vessel when the treatment vessel is in the loading position.

11. The method of claim 10 wherein the step of tilting the treatment vessel to place the target material in contact with the liquid reactant metal comprises tilting the treatment vessel to a treatment position in which the containment area resides below the level of the liquid reactant metal in the treatment vessel.

12. The method of claim 8 wherein the step of removing reaction products from the treatment vessel includes pouring liquid reactant metal and reaction products entrained in the liquid reactant metal from the treatment vessel.

* * * * *